United States Patent [19]

Smith et al.

[11] 4,311,125

[45] Jan. 19, 1982

[54] FUEL INJECTION PUMP WITH UNIVERSAL GOVERNOR PLATE SUSPENSION SYSTEM

[75] Inventors: Arthur W. Smith, Glastonbury, Conn.; Marcus J. Gottsche, Hampden, Mass.

[73] Assignee: Stanadyne, Inc., Windsor, Conn.

[21] Appl. No.: 113,526

[22] Filed: Jan. 21, 1980

[51] Int. Cl.[3] ..... F02D 31/00

[52] U.S. Cl. ..... 123/364

[58] Field of Search ..... 123/364, 385, 387, 339

[56] References Cited

U.S. PATENT DOCUMENTS

| | | | |
|---|---|---|---|
| 2,865,347 | 12/1958 | Roosa | 123/364 X |
| 2,949,904 | 8/1960 | Bischoff et al. | 123/364 |
| 3,219,020 | 11/1965 | Roosa | 123/387 |
| 3,288,124 | 11/1966 | Roosa | 123/385 X |
| 3,313,282 | 4/1967 | Dreisin | 123/385 X |
| 3,460,479 | 8/1969 | Kemp | 123/364 X |
| 3,650,259 | 3/1972 | Garnier | 123/364 |
| 3,946,713 | 3/1976 | Laufer | 123/387 |
| 4,041,921 | 8/1977 | Eckert et al. | 123/364 |
| 4,142,499 | 3/1979 | Salzgeber | 123/339 |
| 4,267,808 | 3/1981 | Djordjelic et al. | 123/364 |

*Primary Examiner*—Wendell E. Burns

*Attorney, Agent, or Firm*—Prutzman, Kalb, Chilton & Alix

[57] ABSTRACT

A fuel injection pump for internal combustion engines is provided with an engine speed responsive governor having a governor arm suspension system that includes a spherical pivot fulcrum and a complimentary concave pivot surface on the governor arm to permit multi-directional articulation of the arm thereby preventing the slidable governor sleeve from binding on the drive shaft of the pump driven by the engine.

6 Claims, 3 Drawing Figures

FUEL INJECTION PUMP WITH UNIVERSAL GOVERNOR PLATE SUSPENSION SYSTEM

The present invention relates generally to fuel injection pumps for internal combustion engines and more particularly is concerned with a new and improved fuel injection pump having an engine speed responsive governor for adjusting the metering valve of the pump.

In the operation of internal combustion engines where fuel injection is employed, a metered charge of liquid fuel is delivered under high pressure to each engine cylinder in synchronism with the engine operation cycle. This may be controlled by using an engine speed responsive governor of the type described in U.S. Pat. No. 2,865,347 issued to Vernon D. Roosa and entitled "Control Means For A Fuel Pump Valve". Governors of this type use a governor arm suspension system that includes a pivotable governor arm or plate having a transversely extending pivot line recess mounted on an elongated pivot shaft having a knife edge fulcrum. In such a structure, it is necessary to carefully machine the mounting holes for the pivot shaft in the housing of the pump to assure accurate positioning of the pivot. Attention to detail and accurate machining is required in order to maintain the necessary parallelism of the pivot line and the toes or free ends of the governor arm that engage the weighted governor sleeve slidably mounted on the drive shaft of the pump driven by the engine. If such parallelism is not maintained, the sleeve may skew and cause binding of the sleeve on the shaft thereby causing erratic operation of the governor and the metered delivery of fuel to the engine cylinders.

Additional prior patents relating to the operation of pump governors of this type include U.S. Pat. Nos. 3,219,020 and 3,288,124, both of which describe the knife edge governor plate suspension system described in greater detail in the earlier mentioned Roosa patent.

In accordance with the present invention, there is provided a fuel injection pump of the type described that eliminates the pivot line and the knife edge pivot shaft and its associated mounting holes as well as the need for a carefully machined pivot construction while obviating the possibility of potential leak sources within the housing of the pump. The present invention incorporates a governor arm suspension system capable of providing the multi-directional articulation necessary to equalize the thrust loads on the weighted sleeve without requiring difficult to machine parallelism within the pivot line and the toe areas of the governor arm. This eliminates any misalignment of the governor sleeve on the drive shaft and obviates the resultant difficulties mentioned hereinbefore. Additionally, the new construction of the present invention provides improved cost effectiveness as a result of the simplicity of the components, the reduction in the need for machining operations, and the simplification of the assembly operations, as well as a reduction in the number of assembled components.

These and related advantages are achieved in accordance with the present invention by providing a fuel injection pump of the type described with an engine speed responsive governor having a governor arm suspension system that includes a spherical pivot fulcrum fixedly mounted on the pump and a governor arm provided with a concave pivot surface complimentary to and operatively cooperating with the spherical fulcrum to permit multi-directional articulation of the governor arm.

Other objects will be in part obvious and in part pointed out in more detail hereinafter.

A better understanding of the invention will be obtained from the following description and the accompanying drawings of an illustrative application of the invention.

IN THE DRAWINGS

Figure 1:
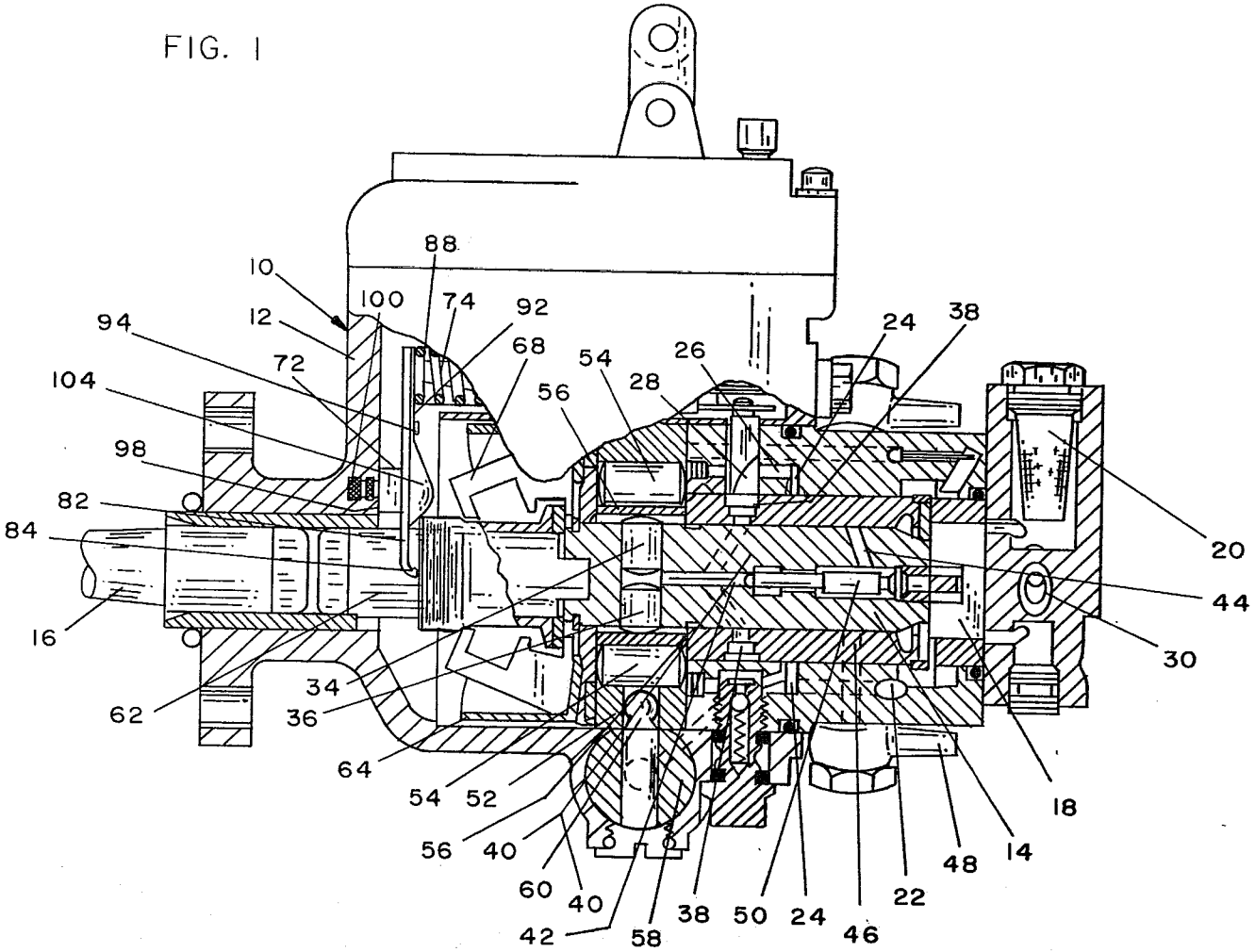
FIG. 1 is a longitudinal side elevational view, partly in section and partly broken away, of a fuel injection pump illustrating a preferred embodiment of the present invention.

Referring now to the drawings in greater detail wherein like reference numerals indicate like parts throughout the several figures, the fuel pump exemplifying the present invention is shown to be of the type adapted to supply sequential measured pulses or charges of fuel under high pressure to the several fuel injection nozzles of an internal combustion engine. The pump 10 is provided with a housing 12 having a fuel distributing rotor 14 mounted within the housing and a drive shaft 16 journaled in the housing for being driven by an engine (not shown).

A vane-type transfer or low pressure supply pump 18 is driven by the rotor 14 and receives fuel from a supply tank (not shown) through pump inlet 20. The output of the pump 18 is delivered under pressure via axial passage 22, annulus 24, and passage 26 to metering valve 28. A transfer pump pressure regulating valve, generally denoted by the numeral 30, regulates the output pressure of the transfer pump and returns excess fuel to the pump inlet 20. The regulator 30 is designed to provide transfer pump output pressure which increases with engine speed in order to meet the increased fuel requirements of the engine at higher speeds and to provide a fuel pressure suitable for operating auxiliary mechanisms of the fuel pump.

A high pressure charge pump 32, comprising a pair of opposed plungers 34 is mounted for reciprocation in a diametral bore 36 of the rotor, receives metered inlet fuel from the metering valve 28 through a plurality of angularly spaced radial ports 38 (only 2 of which are shown) adapted for sequential registration with a diagonal inlet passage 40 of rotor 14 as it is rotated.

A charge of fuel is pressurized to high pressure by the charge pump 32 and is delivered through an axial bore 42 of the rotor to a delivery passage 44 which registers sequentially with a plurality of angularly spaced outlet passages 46 (only 1 of which is shown) which communicate respectively with the individual fuel injection nozzles of the engine through discharge fittings 48 spaced around the periphery of the housing 12. A delivery valve 50 in the axial bore 42 operates to achieve sharp cut off of fuel to the nozzles at the end of the pumping stroke of charge pump 32 to eliminate fuel dribble into the engine combustion chambers.

The angularly spaced inlet passages 38 are located around the periphery of the rotor bore to provide sequential registration with the diagonal inlet passage 40 of the rotor 18 during the intake stroke of the plungers 34, and the angularly spaced outlet passages 46 are similarly located to provide sequential registration with the distributor passage 44 during the compression stroke of the plungers.

An annular cam ring 52 having a plurality of pairs of diametrically opposed camming lobes is provided for simultaneously actuating the charge pump plungers 34 inwardly for periodically pressurizing the charge of fuel therebetween to thereby periodically deliver sequential charges of pressurized fuel to the engine. A pair of rollers 54 carried by roller shoes 56 are mounted by the rotor in radial alignment with the plungers 38 for camming the plungers inwardly. For timing the distribution of the pressurized fuel to the fuel nozzles in proper synchronism with the engine operation, the annular cam ring 52 is adapted to be angularly adjusted by a suitable timing control piston 58 which is connected to cam ring 52 by connector pin 60.

As described in the aforementioned U.S. Pat. No. 2,865,347, the rotor 14 is provided with a stub shaft 62 suitably attached to the drive shaft 16. A governor is disposed around the stub shaft and consists of a weight retainer 64 fixed to the rotor 14, a sleeve 66 slidably mounted on shaft 62, and a plurality of governor weights 68 mounted around shaft 62 for rotation therewith to provide a variable axial force on the sleeve 66. The sleeve 66 is engaged by and cooperates with a pivoted governor arm 70 to urge the arm clockwise as viewed in FIGS. 1 and 2 about its supporting pivot, designated generally by the numeral 72. The governor arm 70 is urged in the opposite pivotal direction by a governor spring assembly 74, the axial position of which is adjustable through an interconnection with the controlling foot pedal in the driver's compartment of the automobile.

As is well known, the quantity or measure of the charge of fuel delivered by the pump in a single pumping stroke is a function of the fuel pressure and is readily controlled by varying the restriction offered by the metering valve 28 to the passage of fuel therethrough. As more fully described in U.S. Pat. No. 4,142,499 issued to Daniel E. Salzgeber and entitled "Temperature Compensated Fuel Injection Pump", the governor arm 70 is connected to control the angular position of the metering valve 28. The governor operates under the bias of the spring assembly 74 to control the angular position of the metering valve 28, the measure of the charge and therefore the speed of the associated engine. If speed begins to increase, the centrifugal force of the governor rotates the metering valve 28 thereby to increase the restriction to the flow of fuel past the metering valve. Thus, the governor automatically regulates the engine speed in the idle speed range and at maximum speed with the metering of fuel at intermediate speed being controlled solely by the mechanical actuation of the throttle foot pedal.

Figure 2:
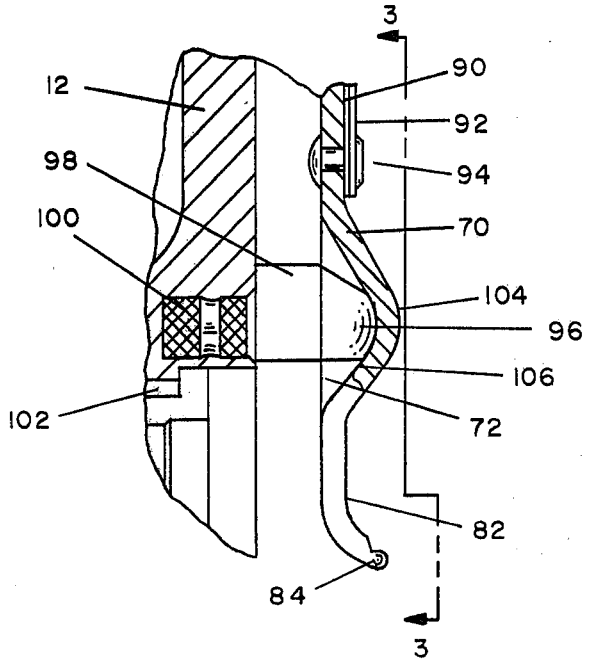
FIG. 2 is an enlarged fragmentary side elevational view, partly in section and partly broken away, of the governor arm suspension system of the fuel injection pump of FIG. 1.
Figure 3:
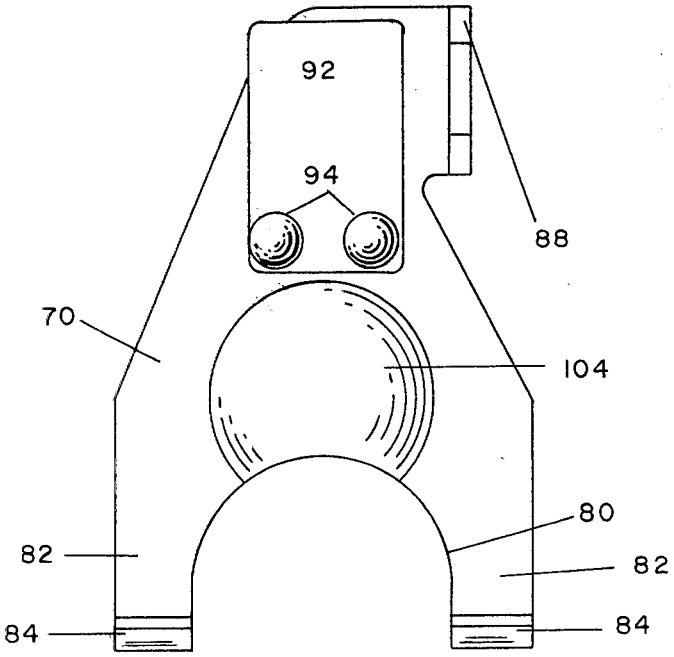
FIG. 3 is a front elevational view of the governor arm of FIG. 2 taken along the line 3—3 of FIG. 2.

Referring now specifically to FIGS. 2 and 3, the pivoted lever or governor arm 70 is of plate-like shape preferably formed as a metal stamping. The lowermost edge thereof has a central semicircular notch 80, best shown in FIG. 3, that straddles the shaft 62 and defines a pair of legs 82 that extend downwardly on opposite sides of the shaft. The legs 82 preferably are formed with turned free edges or toes 84 for engagement with the governor sleeve 66 at diametrically opposite locations on its rim 86. On the opposite end of the governor plate 70 from the sleeve contacting toes 84 is a notched tab 88 extending perpendicular to the main body of the governor plate. The tab 88 is operatively connected to a drive link (not shown) through a lost motion connection for controlling the operation of the metering valve 28. Adjacent the tab 88 on the governor plate 70 there is provided with a pair of cantilever mounted strip members 90, 92 in overlying relationship having one end secured to the governor plate 70 by rivets 94. As more fully described in U.S. Pat. No. 4,142,499 the bi-metal strip member 90 lies parallel to the governor plate at normal temperatures while the leaf spring member 92 resists the bowing of the bi-metal strip from its parallel position and provides a bearing seat for the governor spring assembly 74. If the temperatures within the pump reach a high temperature of, for example, 130° F., the bi-metal strip 90 will begin to bow away from the governor arm 70 to increase the biasing force applied to the spring assembly against the governor plate and increase the metering valve opening thereby to compensate for the normal lessening of fuel delivery of the pump at the preset idling speed of the engine. If the pump temperature drops substantially below the normal temperature range, the bi-metal strip 90 bows in the opposite direction to move the free end of the leaf spring 92 away from the free end of the bi-metal strip to again increase the biasing force and increase the idling speed of the engine at cold temperatures when combustion is less stabilized than under normal operating conditions.

Unlike the construction shown in the aforementioned U.S. Pat. No. 2,865,347 the pivoted governor lever 70 of the present invention is provided with a suspension system that permits universal or multi-directional articulation about its pivot and eliminates the knife edge pivot shaft and the need for its accurately machined mounting holes. In accordance with the present invention and as best shown in FIG. 2, the pivot 72 for the governor arm 70 is a single stud having spherically arcuate nose-like fulcrum end portion 96 supported on a cylindrical base portion 98 and secured to the housing 12 above the shaft 62 by an integral mounting pin 100. The cylindrical base portion 98 abuts the interior wall of the housing 12 while the integral mounting pin 100 is secured by a press fit within an aperture 102 in the housing. Immediately above the semicircular notch 80 of the plate-like governor arm 70 there is provided an arcuate dimple 104 projecting toward the sleeve 66 and having a concave spherical surface 106 that cooperatively interengages the nose-like fulcrum portion 96 of the pivot to provide multi-directional or universal articulation of the governor plate 70.

As can be appreciated the multi-directional articulation of the pivot obviates the need for precisely locating and accurately machining the mounting aperture 102 for the spherical fulcrum. So long as the aperture 102 is centrally located above the shaft 62 the engagement of the opposed toes 84 with the rim 86 of the governor sleeve 66 will facilitate self-centering of the sleeve as it bears against the governor arm under the bias of assembly 74 and permits free sliding movement thereof without the adverse effect of skewing or binding of the sleeve on the shaft.

Additionally, as will be appreciated from the aforementioned construction, the governor arm 70 may be easily assembled by simple mounting the dimple 104 on the governor arm 70 over the spherical fulcrum 96 so that the toes 84 of the governor arm engage the rim 86 of the sleeve of the governor arm can be accommodated by the universal articulation of the pivot and the inherent flexibility within the governor spring assembly 74 and the lost motion interconnection at the tab 88.

As can be seen from the foregoing description the new and improved governor arm support system of the present invention obviates the need for maintaining parallelism between a pivot line on the arm and the free ends of the governor arm and the careful machining attendant thereto. This is achieved by simplifying the components involved, reducing the need for machining operations and simplifying the assembly operations, all resulting in an improved cost effectiveness in the total construction.

As will be apparent to persons skilled in the art, various modifications, adaptations and variations of the foregoing specific disclosure can be made without departing from the teachings of the present invention.

We claim:

1. In a fuel injection pump for an internal combustion engine having a metering valve adjustable in opening and closing directions for variably metering the fuel delivered by the pump to the engine and an engine speed responsive governor including a pivotable governor plate for adjusting the metering valve by providing an increasing force with increasing speed to urge the metering valve in its closing direction and a fixed pivot for the governor plate, the improvement wherein said pivot has a spherical pivot surface and said governor plate is provided with an arcuate surface complimentary to and operatively cooperating with said spherical pivot surface to provide multi-directional pivotal movement of said governor plate.

2. The pump of claim 1 wherein said pivot includes an arcuate nose-like portion carrying said spherical surface and forming a point fulcrum engaging the arcuate surface of the governor plate to provide said multi-directional movement and an integral mounting portion secured to said pump.

3. The pump of claim 1 wherein said governor plate is provided with a dimple intermediate the ends thereof and said arcuate surface is a surface of said dimple.

4. The pump of claim 3 wherein said arcuate surface on said governor plate is a concave surface.

5. The pump of claims 1, 2, 3 or 4 wherein said pivot is a one piece member having a single mounting lug mounted on said pump.

6. The pump of claim 1 wherein said pivot includes a nose-like portion with said spherical pivot surface thereon forming an arcuate point fulcrum and an integral mounting lug secured to said pump, said governor plate having a dimple intermediate its ends with the concave surface of said dimple forming said arcuate surface complimentary to said spherical pivot surface to provide a single multi-directional pivot for said plate on said arcuate fulcrum.

* * * * *